US009475555B2

(12) United States Patent
Melzer

(10) Patent No.: US 9,475,555 B2
(45) Date of Patent: Oct. 25, 2016

(54) APPARATUS AND RELATED METHODS FOR REMOVING DEBRIS FROM THE LEADING EDGE OF FLUID TRAVELING VEHICLES

(71) Applicant: Richard Melzer, San Diego, CA (US)

(72) Inventor: Richard Melzer, San Diego, CA (US)

( * ) Notice: Subject to any disclaimer, the term of this patent is extended or adjusted under 35 U.S.C. 154(b) by 0 days.

(21) Appl. No.: 14/690,231

(22) Filed: Apr. 17, 2015

(65) Prior Publication Data

US 2015/0298778 A1 Oct. 22, 2015

Related U.S. Application Data

(60) Provisional application No. 61/981,712, filed on Apr. 18, 2014.

(51) Int. Cl.
*B63B 59/08* (2006.01)

(52) U.S. Cl.
CPC ..... *B63B 59/08* (2013.01)

(58) Field of Classification Search
CPC ..... B63H 1/28; B63H 5/16; B63B 59/00; B63B 59/06; B63B 59/08; B63B 59/04; B63B 59/10
USPC ..... 114/222; 440/73, 46
See application file for complete search history.

(56) References Cited

U.S. PATENT DOCUMENTS 5,598,804 A * 2/1997 Vostitsanos ..... B63B 59/08 440/46
5,851,130 A * 12/1998 Wainwright ..... B63H 11/04 440/46

* cited by examiner

*Primary Examiner* — Lars A Olson
(74) *Attorney, Agent, or Firm* — Buche & Associates, P.C.; John K. Buche; Bryce A. Johnson

(57) ABSTRACT

Described, in general, is an apparatus and related methods for removing debris from the leading edge of drive shaft housing of a sailboat. In a preferred embodiment, the apparatus comprises: a sleeve in the shape of a leading edge of a drive shaft housing, the sleeve featuring first and second line guides; a blade track along said first line guide; a first section of line; a second section of line; and a slug with a blade; wherein first and second lines are spliced with the slug and positioned in the two line guides so that (a) the slug is in the first line guide with the blade exposed at the line track and (b) pulling the first or second line guide moves the slug within the first line guide and the blade along the blade track. In a preferred mode of operation, the sleeve may be installed at the leading edge of a drive shaft housing of a sail boat, the lines run through the hull, through the motor mount inside the boat and too the upper surface, whereby manipulating the unspliced ends of either the first or second lines results in movement of the blade along the blade track.

1 Claim, 7 Drawing Sheets

APPARATUS AND RELATED METHODS FOR REMOVING DEBRIS FROM THE LEADING EDGE OF FLUID TRAVELING VEHICLES

CROSS-REFERENCE TO RELATED APPLICATIONS

This is application claims the benefit and priority of U.S. Prov. Pat. App. Ser. No. 61/981,712 (filed Apr. 18, 2014) entitled "Apparatus and related methods for removing debris from the leading edge of fluid traveling vehicles." That document is incorporated by reference in its entirety as if fully set forth herein.

STATEMENT REGARDING FEDERALLY SPONSORED RESEARCH OR DEVELOPMENT

Not applicable.

BACKGROUND OF THE INVENTION

1. Field of Invention

The subject matter of this written description is in the field of devices for removing debris from the leading edge of appendages on fluid traveling objects, and more specifically, the drive housing of a sailboat.

2. Background of the Invention

Boats are well-known vehicles for traveling through water. In almost every case, boats have a plurality of appendages with leading edges that cut through the water while the boat is moving. For instance, sail boats have leading edges of the hull, keel, propeller drive shaft housing (for sail boats that also feature motors), and rudder that must move through the water while the boat is moving. Leading edges of sail boat appendages (or any other fluid traveling vehicle) become problematic because they can accumulate debris (e.g., kelp strands) which, as a result, undesirably increases the drag of the sail boat as it moves through water.

The leading edge of a sail boat's hull is usually not a large concern for accumulating debris because the hull's leading edge is typically at the front of the boat and just below the water surface where debris can be removed via pushing the debris away or under the boat from the boat's deck. Similarly, accumulated debris at the leading edge of a sail boat's rudder does not raise a major concern because the rudder is located at the rear of the boat and relatively easy to access for debris removal from the boat's deck. Removing debris from the leading edge of the drive shaft housing or keel of a sail boat, however, is more problematic since those boat components are located underneath the boat and difficult to access for debris removal from the deck. In view of the foregoing, a need exists for apparatus and related methods for removing debris from the leading edges of boats' drive housing or keel.

One known way of removing the debris, like kelp strands, from the leading edge of a sail boat keel is by operating a vertical rod with a blade on its lower end, wherein the rod is positioned so the upper end of the rod is exposed at the sail boat's deck while the lower end is positioned below the boat's hull whereby raising or lowering the rod (like a plunger) from the deck moves the blade along the leading edge of the keel and cuts debris free from the leading edge. In one embodiment, movements of the rod result in a scissor action of the blade along the leading edge. See, e.g., U.S. Pub. Pat. App. Ser. No. 2007/0151496 (published Jul. 5, 2007) entitled "device and method for removing kelp/debris from a keel." It is important to note that these rod driven debris removal systems are typically positioned within vertical tubes inside of the boat so that the tubes are in fluid communication with the water, but the tubes do not allow water to flood the boat because the upper end of the tube is positioned above the waterline.

Rod driven debris cutters are suitable for removing debris from a sailboat's keel. However, these rod driven devices cannot be applied to the propeller drive shaft housing of a sail boat because the motor (e.g., the Yanmar™ or other soft mounted motor) is positioned directly above the drive shaft whereby a rod with a blade cannot be provided to a location that enables a blade to interact with the leading edge of the drive shaft housing. For this and other reasons, drive shaft housings are often positioned directly behind the keel of the sail boat so that removing debris removed from the keel will not have a chance to interact with the drive shaft housing. Nevertheless, debris, like kelp strands, frequently catches the leading edge of the drive shaft housing and there is not a suitable mechanism for cutting or other debris removal mechanisms.

SUMMARY OF THE INVENTION

In view of the foregoing, it is a primary object of this disclosure to describe an apparatus and related methods for removing debris from the leading edge of drive shaft housing of a sailboat. In a preferred embodiment, the apparatus comprises: a sleeve in the shape of a leading edge of a drive shaft housing, the sleeve featuring first and second line guides; a blade track along said first line guide; a first section of line; a second section of line; and a slug with a blade; wherein first and second lines are spliced with the slug and positioned in the two line guides so that (a) the slug is in the first line guide with the blade exposed at the line track and (b) pulling the first or second line guide moves the slug within the first line guide and the blade along the blade track. In a preferred mode of operation, the sleeve may be installed at the leading edge of a drive shaft housing of a sail boat, the lines run through the hull, through the motor mount inside the boat and to the upper surface, whereby manipulating the unspliced ends of either the first or second lines results in movement of the blade along the blade track.

Other objectives and desires may become apparent to one of skill in the art after reading the below disclosure and viewing the associated figures.

BRIEF DESCRIPTION OF THE FIGURES

The manner in which these objectives and other desirable characteristics can be obtained is explained in the following description and attached figures in which.

It is to be noted, however, that the appended figures illustrate only typical embodiments of the disclosed assemblies, and therefore, are not to be considered limiting of their scope, for the disclosed assemblies may admit to other equally effective embodiments that will be appreciated by those reasonably skilled in the relevant arts. Also, figures are not necessarily made to scale.

DETAILED DESCRIPTION OF PREFERRED EMBODIMENTS

Disclosed is an apparatus and related methods for removing debris from the leading edge of drive shaft housing of a sailboat. In a preferred embodiment, the apparatus comprises: a sleeve in the shape of a leading edge of a drive shaft housing, the sleeve featuring first and second line guides; a blade track along said first line guide; a first section of line; a second section of line; and a slug with a blade; wherein first and second lines are spliced with the slug and positioned in the two line guides so that (a) the slug is in the first line guide with the blade exposed at the line track and (b) pulling the first or second line guide moves the slug within the first line guide and the blade along the blade track. In a preferred mode of operation, the sleeve may be installed at the leading edge of a drive shaft housing of a sail boat, the lines run through the hull, through the motor mount inside the boat and to the upper surface, whereby manipulating the unspliced ends of either the first or second lines results in movement of the blade along the blade track. Other specific details of the device are disclosed with reference to the figures.

Figure 1:
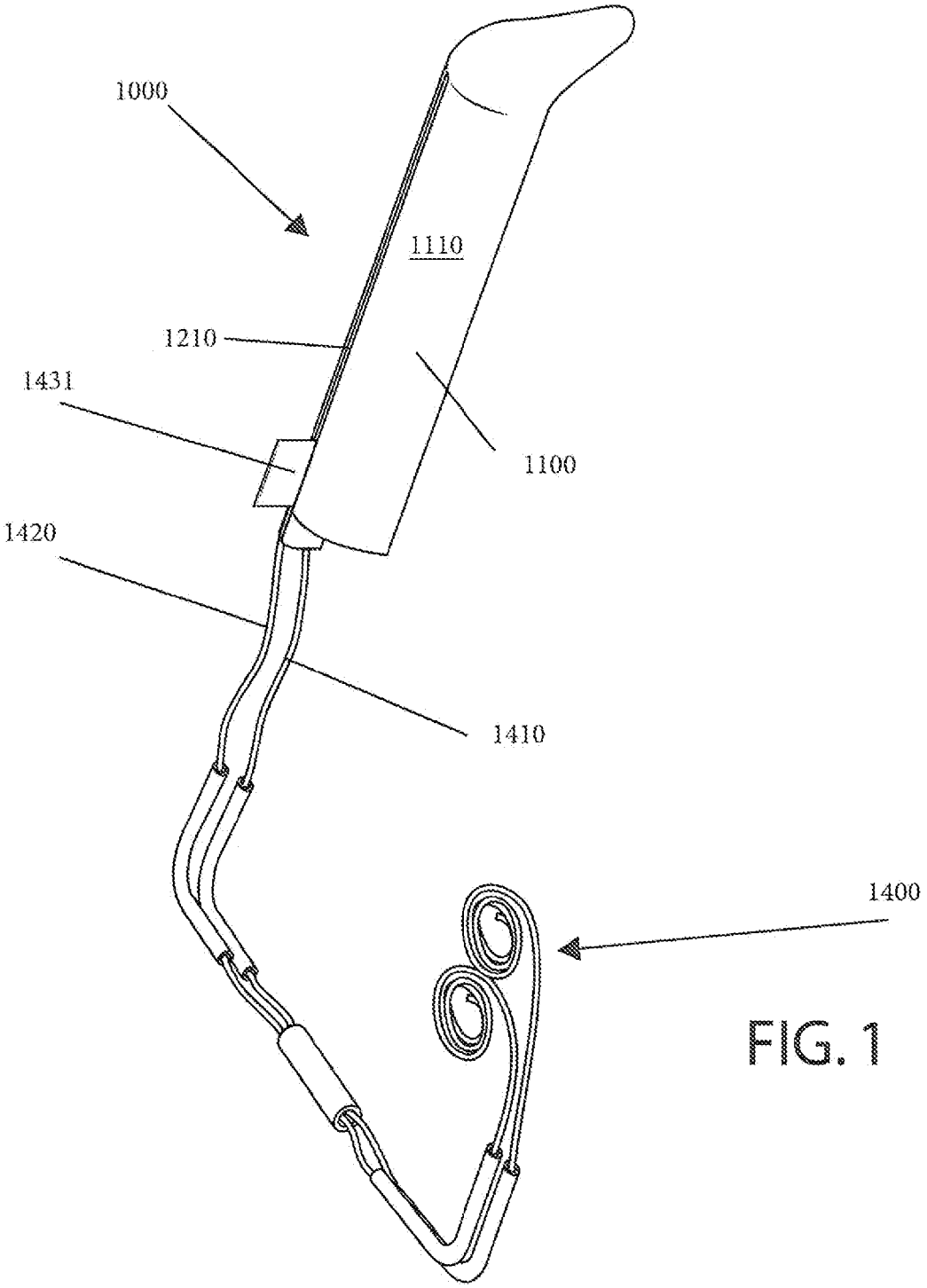
FIG. 1 is a perspective view of an apparatus.
Figure 2:
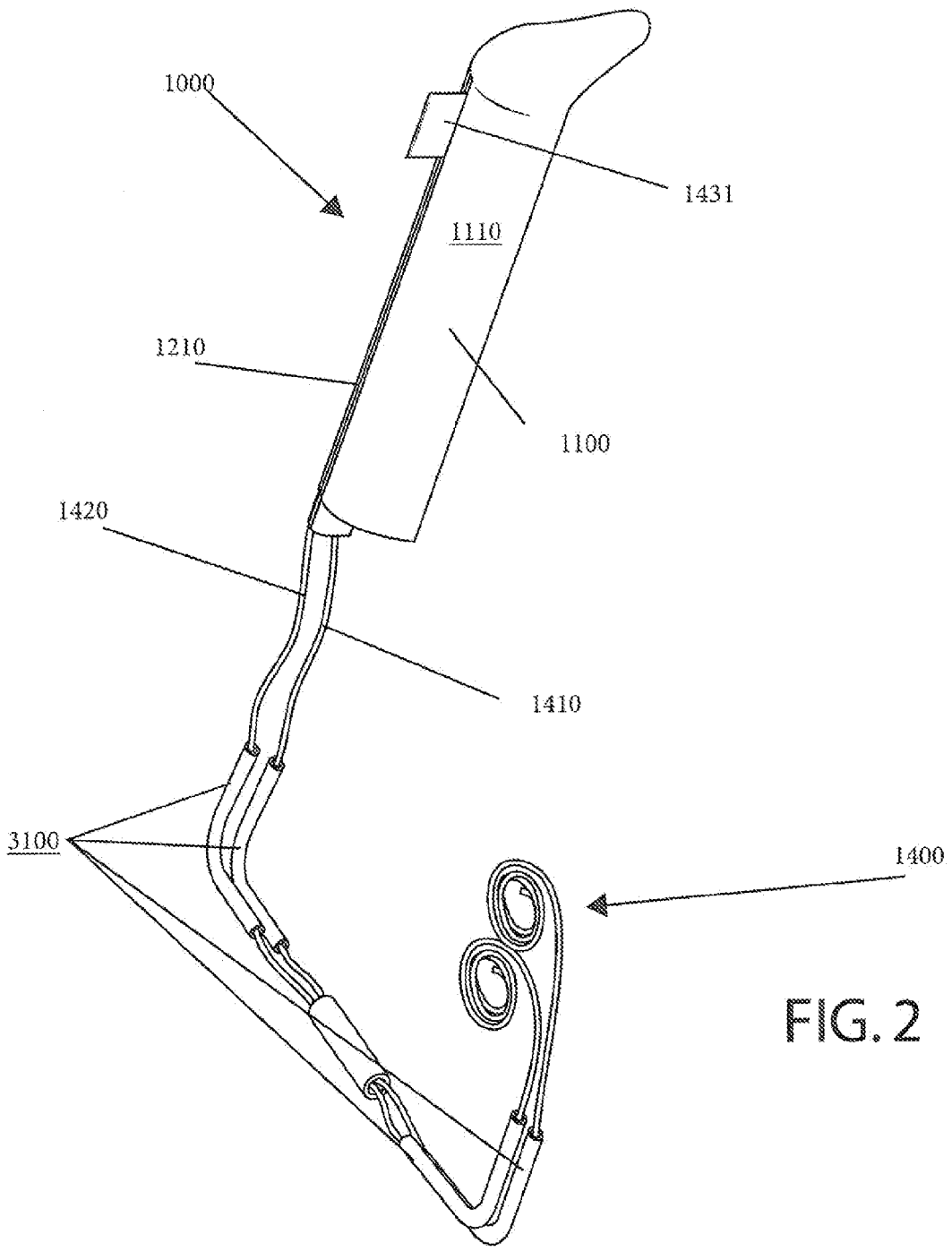
FIG. 2 is another perspective view of the apparatus.
Figure 7:
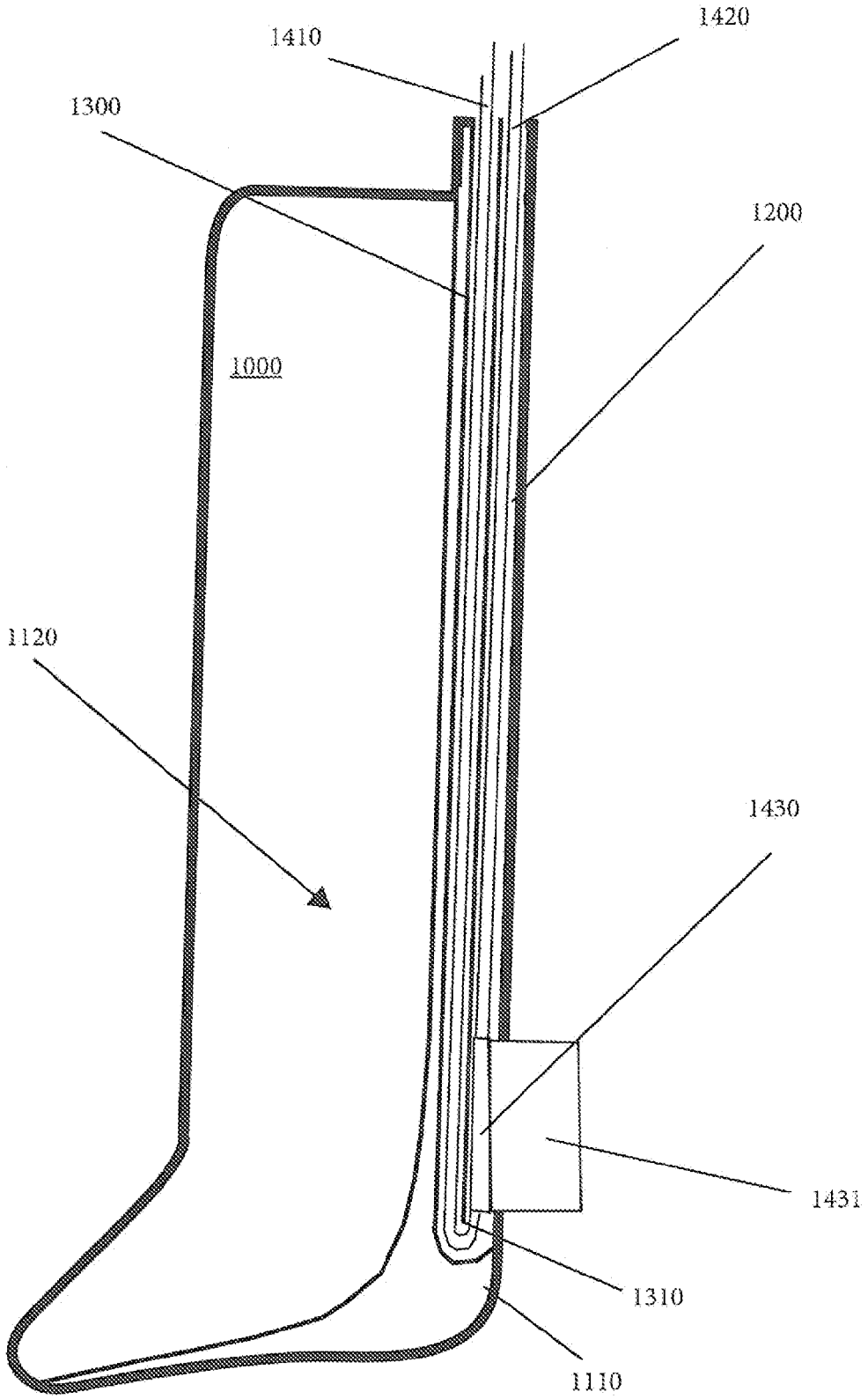
FIG. 7 is a cross-section of the apparatus.
Figure 8:
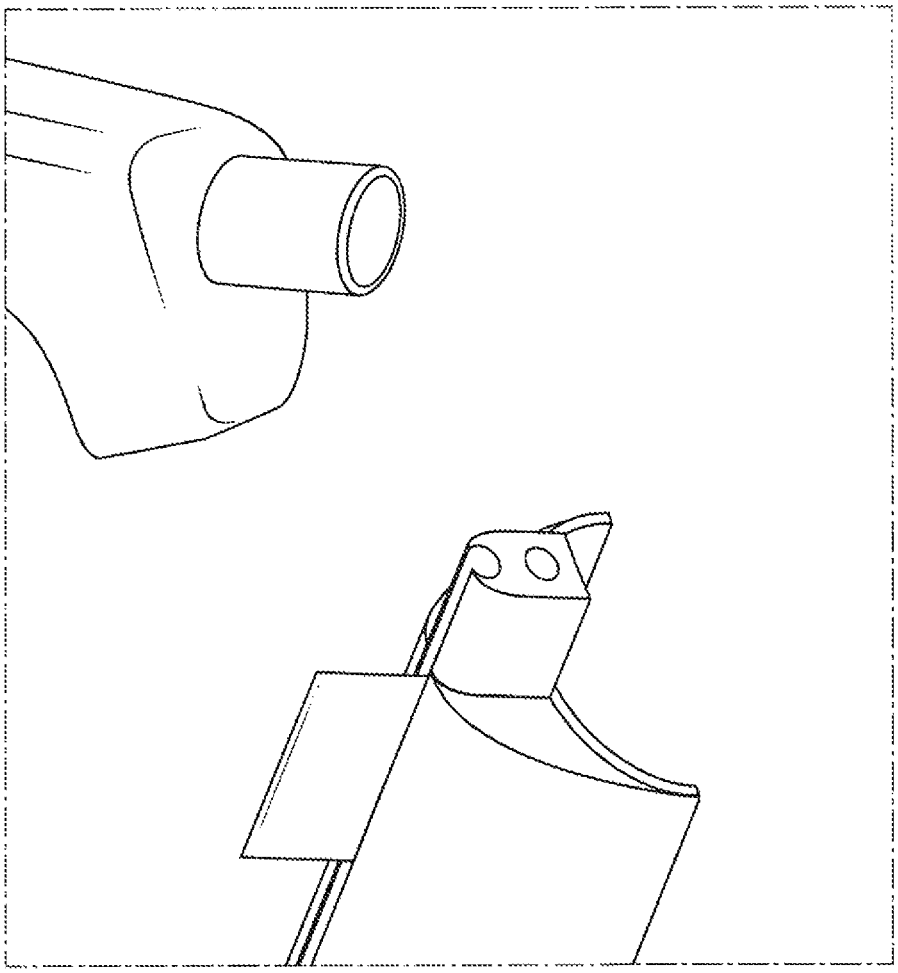
FIG. 8 is a perspective view of the top of the apparatus and insert through the motor mount of a drive shaft housing of a sail boat.

FIGS. 1 and 2 are front bottom perspective views of an apparatus 1000 for removing debris from the leading edge of a shaft housing for a sailboat motor. As discussed in greater detail below, the difference between FIGS. 1 and 2 is that the location of the blade 1431 along the length of the apparatus. FIG. 2 is a front top perspective of the apparatus 1000 of FIGS. 1 and 2. Finally, FIG. 7 is a cross section of the apparatus of FIGS. 1 through 3. As shown in these figures, the apparatus comprises a sleeve 1100; a first line guide 1200 (FIG. 3) with a blade track 1210; a second line guide 1300 (FIG. 3); and a control line 1400 with two sections 1410, 1420 (FIG. 7) that have been spliced with a bladed slug 1430 (FIG. 7).

Figure 3:
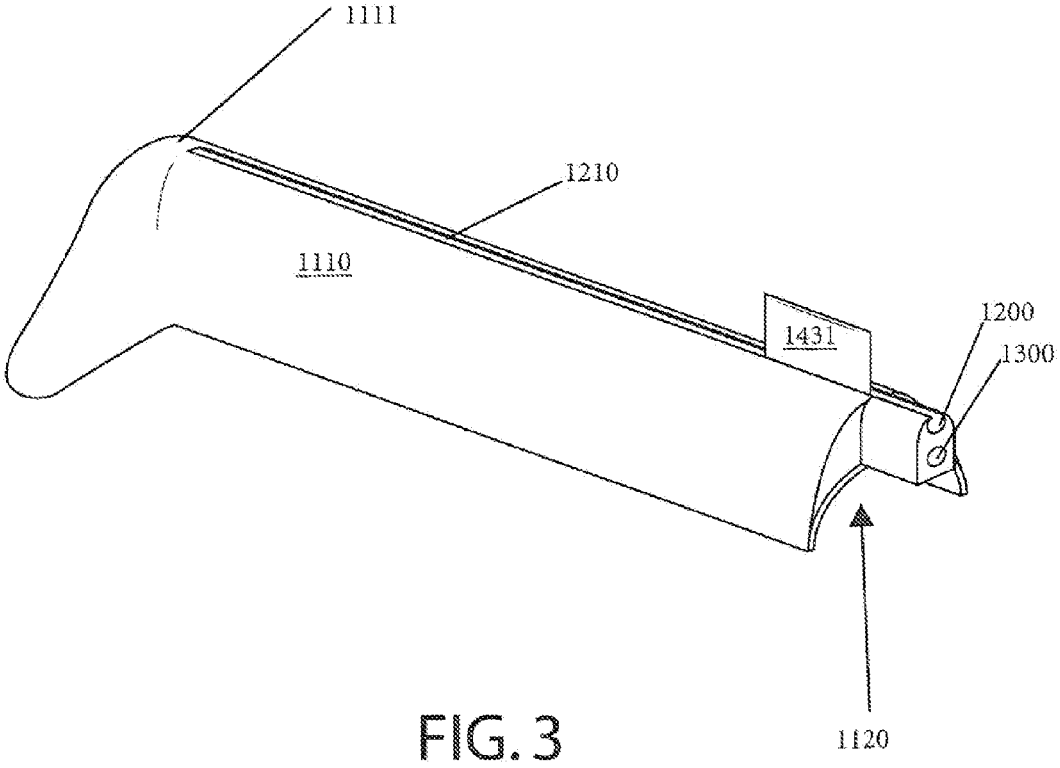
FIG. 3 is another perspective view of the apparatus.

Referring to FIGS. 1, 3, and 7, the sleeve 1100 is defined by a leading edge 1110 and drive housing receptacle 1120 defined by an indentation in the sleeve 1000. As shown in FIG. 7, the first and second line guides 1200, 1300 are positioned within the sleeve 1100, between the leading edge 1110 and housing receptacle 1120. In a preferred embodiment, the blade track 1210 of the first line guide 1200 is located along the leading edge 1110 as depicted in FIGS. 1 through 3. As discussed below, the housing receptacle 1120 is configured to femininely receive the leading edge of a drive shaft housing whereby the leading edge 1110 of the sleeve 1100 replaces the leading edge of the drive shaft housing. In a preferred embodiment, the sleeve 1100 and line guides 1200,1300 are constructed of molded fiberglass or other corrosion resistant composite.

Referring to FIGS. 3 and 7, the control line 1400 is threaded through the line guides 1200, 1300 so that the bladed slug 1430 (FIG. 7) is positioned within the first line guide 1200 and so that blade 1431 is positioned within the blade track 1210 (FIG. 3). Suitably, the first and second line guides 1200, 1300 are in fluid communication whereby stringing the line 1400 through the line guides 1200, 1300 and moving the first section 1410 of the line 1400 through the second line guide 1300 causes the bladed slug 1430 to move within the first line guide 1200 so that the blade 1431 moves along the blade track 1430. When the lines 1410, 1420 are moved in the opposite directions so that the second section 1420 is moved further within the first line guide 1200 while the blade 1431 and blade slug 1430 move upward along the guide 1200 and track 1210 respectively. As shown in FIG. 7, the junction 1310 of the first and second guides 1200, 1300 is defined by a one-hundred and eighty degree turn. However, a pulley or other mechanism may be proved at the junction 1310 to prevent rubbing of the control line 1400 during movement. In a preferred embodiment, the first and second sections 1410, 1420 are constructed of Spectra™ line with a buried weave for coupling the lines to the slug 1430. In one embodiment, the line is nylon and of a gauge that is capable of nearly filling the volume of the line guides 1200, 1300 when wet. Suitably, the bladed slug 1430 and blade 1431 may be constructed of corrosion resistant steel.

Figure 4:
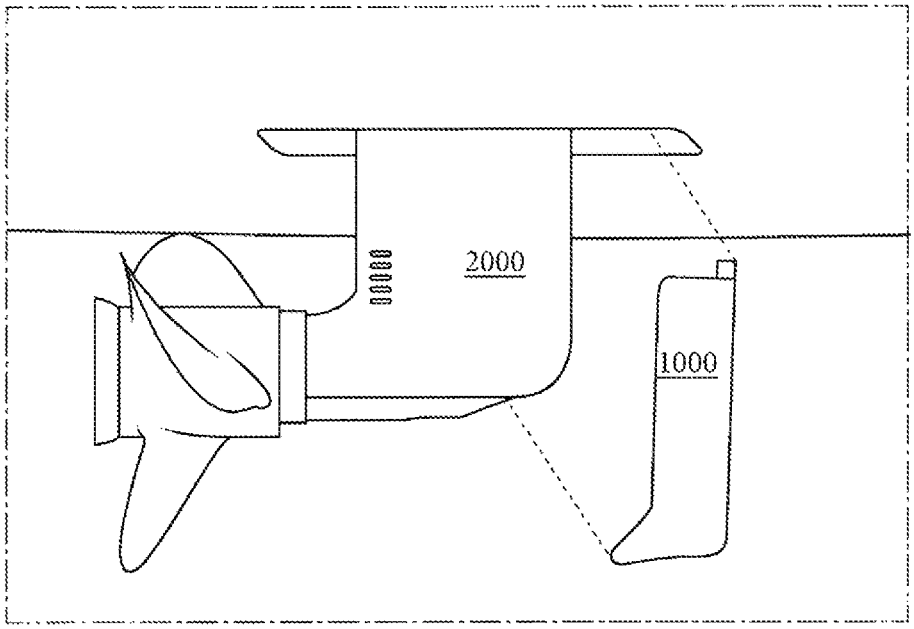
FIG. 4 is an environmental view of the apparatus and a propeller drive shaft housing of a sailboat.
Figure 5:
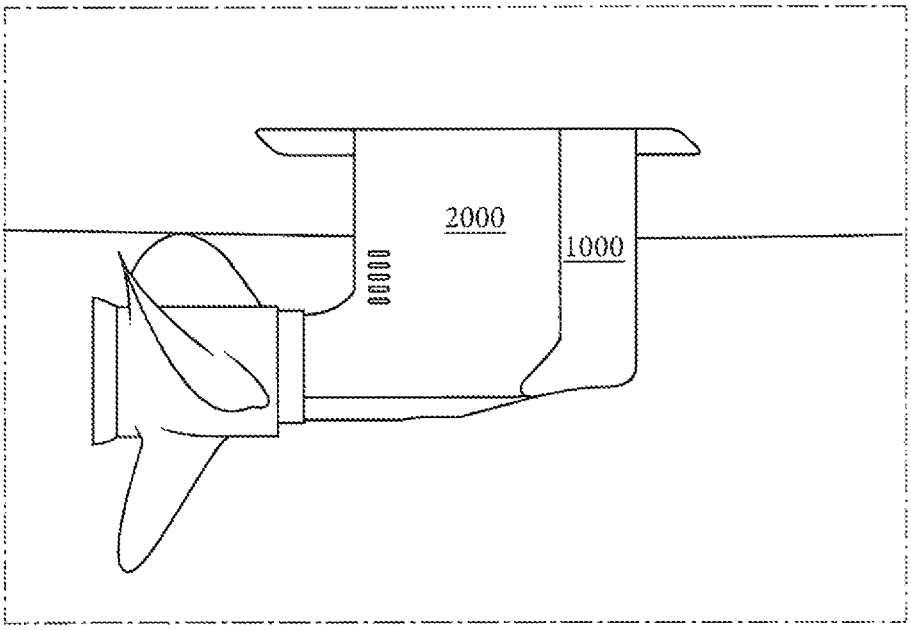
FIG. 5 is another environmental view of the apparatus and a propeller drive shaft housing of a sailboat; and, FIG. 6 is a cross section of the apparatus, the drive shaft housing of a sailboat, the motor mount, and the motor mount of the sailboat.

FIGS. 4 and 5 are environmental views of the apparatus 1000 and a propeller drive shaft housing 2000 of a sailboat. As shown in the drawings, the apparatus 1000 may be installed on a drive shaft via inserting the elbow of the drive shaft housing 2000 into the drive shaft receptacle 1120 (FIG. 7), whereby the leading edge 1110 (FIGS. 1 through 3 and 7) of the sleeve 1100 (FIGS. 1 through 3 and 7) replaces the leading edge of the drive shaft 2000. Further installation of the apparatus 1000 is disclosed with reference to FIG. 6.

Figure 6:
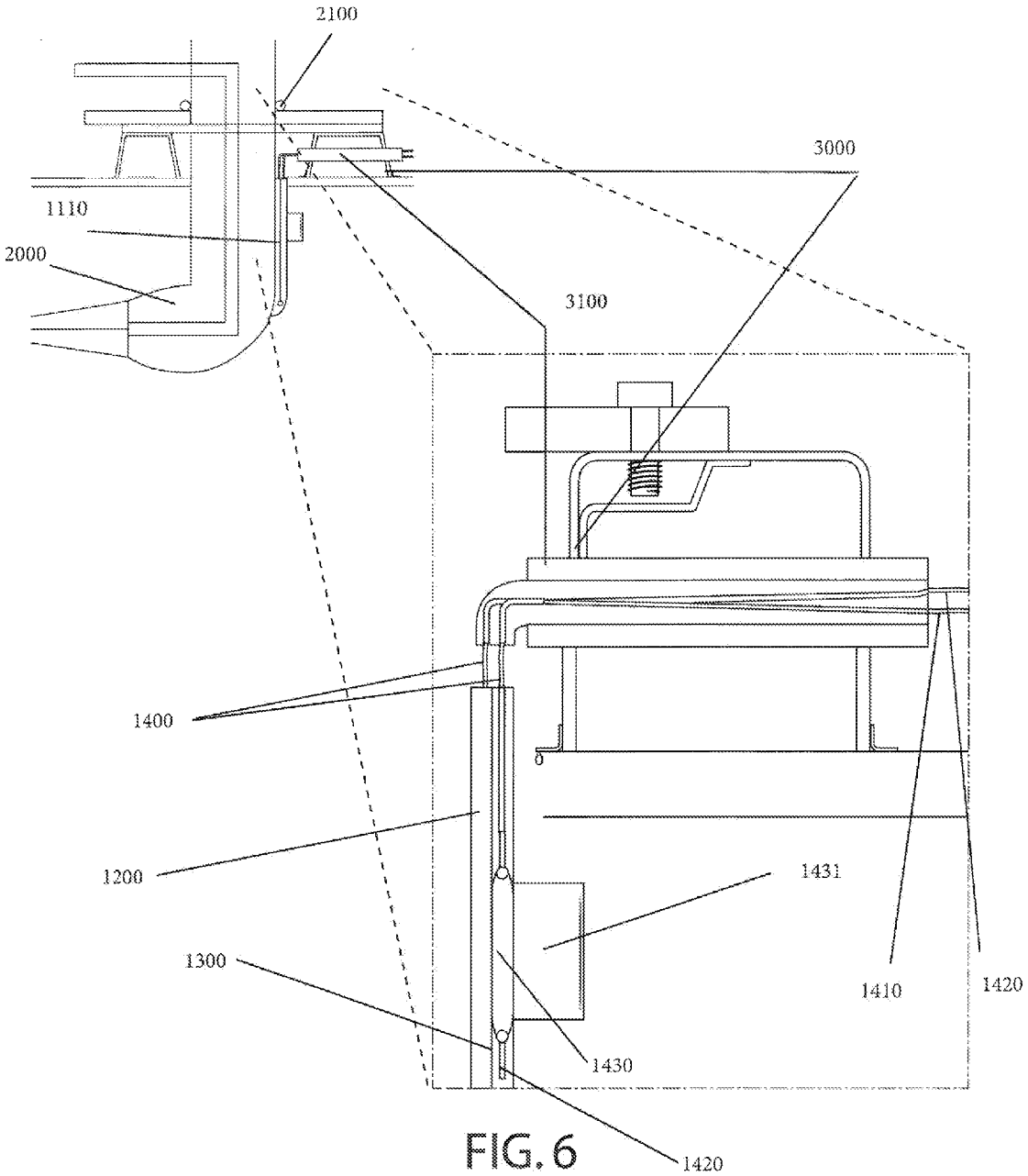

FIG. 6 is a cross section of the apparatus 1000, the drive shaft housing 2000 of a sailboat, and the motor mount 3000 of a sailboat. As shown, the drive shaft housing 2000 is mounted to the boat via the motor mount 3000. Suitably, the housing and the motor mount interface via rubber soft mounts 2100 that create a water tight seal between housing 2000 and the motor mount 3000 while still allowing the housing vibrate when operated. Suitably, the sleeve 1100 is installed on the leading edge of the housing 2000, as shown above in connection with FIGS. 4 and 5. In a preferred embodiment, the line 1400 is run through the sidewall of a motor mount 3000 via housing tubing 3100 that has been installed with a water tight seal through the motor mount 3000 sidewall. In a preferred embodiment, the tubing 3100 may be snaked through the boat to any location above the deck, whereby ends of the first and second section 1410, 1420 of the control line 1400 may be accessed. Suitably, the first and second sections of the line may be provided through the corners and bends of the housing tubing via corner ferrells 3110 (see also FIG. 1) and separated using guidance tubes to avoid tangling. When so installed pulling the first or second sections of the control line will move the blade up or down the leading edge of the apparatus 1000.

While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

In one embodiment, the apparatus 1000 disclosed may be installed on the drive housing of a soft mount rotor (i.e., after market). In an alternative embodiment, the apparatus 1000 may be built-in to the housing of a motor shaft.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments. For instance, the disclosed apparatus may be applied to a leading edge of any vehicle that moves through fluids.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

I claim:

1. An apparatus for removing debris from an edge of an appendage of a vehicle for traveling through fluid wherein the apparatus comprises:

A flexible control line system to control a blade that is housed within the edge, wherein the edge is on a rudder.

* * * * *